US011603856B2

(12) United States Patent
Wagers et al.

(10) Patent No.: US 11,603,856 B2
(45) Date of Patent: Mar. 14, 2023

(54) BACKWARD CURVED PLENUM FAN HAVING ENHANCED EFFICIENCY

(71) Applicant: TRANE INTERNATIONAL INC., Davidson, NC (US)

(72) Inventors: Nathan Wagers, Panama City, FL (US); Ramesh Vedula, Karnataka (IN); Karthik Sankar Ram, Tamil Nadu (IN); Ganesh Narayana, Karnataka (IN)

(73) Assignee: TRANE INTERNATIONAL INC., Davidson, NC (US)

( * ) Notice: Subject to any disclaimer, the term of this patent is extended or adjusted under 35 U.S.C. 154(b) by 313 days.

(21) Appl. No.: 16/702,144

(22) Filed: Dec. 3, 2019

(65) Prior Publication Data

US 2020/0173454 A1 Jun. 4, 2020

(30) Foreign Application Priority Data

Dec. 3, 2018 (IN) ..... 201811045694

(51) Int. Cl.
*F04D 29/24* (2006.01)
*F04D 29/28* (2006.01)

(52) U.S. Cl.
CPC ..... *F04D 29/281* (2013.01); *F04D 29/242* (2013.01)

(58) Field of Classification Search
CPC ..... F04D 29/281; F04D 29/242; F04D 29/30
See application file for complete search history.

(56) References Cited

U.S. PATENT DOCUMENTS

| | | | | |
|---|---|---|---|---|
| 8,225,623 | B2 | 7/2012 | Ikeda et al. | |
| 9,995,311 | B2 * | 6/2018 | Son | B21D 11/20 |
| 10,030,667 | B2 * | 7/2018 | Pirouzpanah | F04D 25/08 |
| 10,036,400 | B2 | 7/2018 | Cocks et al. | |
| 10,428,838 | B2 * | 10/2019 | Song | F04D 17/16 |
| 11,236,760 | B2 * | 2/2022 | Yang | F04D 29/328 |
| 2015/0275922 | A1 | 10/2015 | Son | |

OTHER PUBLICATIONS

Ebm-papst Mulfingen GmbH & Co. KG, "K3G500-PA24-09 Operating Instructions", Sep. 29, 2016 (12 pages).
Ebm-papst Mulfingen GmbH & Co KG, "K3G500-PA24-09 EC centrifugal module—RadiPac backward-curved, single-intake with support bracket", Sep. 29, 2016 (7 pages).
Photograph of EBM Papst R3G500-PW99-05, at least as early as Jul. 20, 2018.

* cited by examiner

*Primary Examiner* — Sabbir Hasan
(74) *Attorney, Agent, or Firm* — Hamre, Schumann, Mueller & Larson, P.C.

(57) ABSTRACT

A centrifugal fan for use as a blower in a heating, ventilation, air conditioning, and refrigeration (HVACR) system has a plurality of blades each having a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L over the diameter of the centrifugal fan divided by the diameter D satisfies the inequality $0.25 \leq L/D \leq 0.42$. The fan blades having these parameters provide improved fan efficiency at certain operating conditions. The fan blades may further have a forward or radial sweep. The fan blades may have a uniform thickness from the leading edge to the trailing edge.

20 Claims, 6 Drawing Sheets

BACKWARD CURVED PLENUM FAN HAVING ENHANCED EFFICIENCY

FIELD

This disclosure is directed to high-efficiency centrifugal fans including blades having a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L divided by the diameter D of the centrifugal fan satisfies the inequality $0.25 \leq L/D \leq 0.42$.

BACKGROUND

Light commercial heating, ventilation, air conditioning and refrigeration (HVACR) units, such as three-ton to twenty-five-ton rooftop units, are used to provide heating, cooling, or ventilation to enclosed spaces, such as the interiors of big box stores, schools, restaurants, office buildings, and the like. Light commercial HVACR units typically use one or more centrifugal fans to drive airflow through the unit and into a structure where the air is conditioned by the HVACR unit. The centrifugal fans are typically driven by electric motors.

Regulatory requirements are regularly increasing the minimum efficiency required for refrigeration units, and thus require improved efficiency from the fans used in HVACR units. Increasingly, HVACR units require more air to be moved for the same or less power.

Current centrifugal fans typically include airfoil-shaped blades, with thicknesses that vary in the direction from the leading edge to the trailing edge along the fan blade.

SUMMARY

This disclosure is directed to high-efficiency centrifugal fans including blades having a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L divided by the diameter D of the centrifugal fan satisfies the inequality $0.25 \leq L/D \leq 0.42$.

Fan embodiments achieve increased energy efficiency at operating speeds and flow rates used in light commercial HVACR applications such as 3-ton to 25-ton units, and produce air flows of, for example, 2000 to 3000 $ft^3$/minute. This improved efficiency allows the fans and HVACR units using those fans to keep up with regularly increasing efficiency standards. Fan embodiments also satisfy these increasing efficiency standards while using blades of consistent thickness, allowing manufacture from plastic or sheet metal, and more easily and inexpensively manufactured than airfoil-shaped blades.

A centrifugal fan blade assembly embodiment includes a plurality of blades each having a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L divided by the diameter D of the centrifugal fan satisfies the inequality $0.25 \leq L/D \leq 0.42$.

In an embodiment, the thickness of each of the blades is consistent from the leading edge of the blade to the trailing edge of the blade, within manufacturing tolerances.

In an embodiment, each of the blades includes plastic. In an embodiment, each of the blades includes at or about 30 to at or about 50% by mass of glass fill as well as plastic. In an embodiment, the plastic is nylon 6 or nylon 66. In an embodiment where the blades are plastic, each of the blades may be at or about 0.191 inches in thickness. In an embodiment, each of the blades includes aluminum. In an embodiment, each of the blades includes steel. In an embodiment where the blades are sheet metal, each of the blades may be at or about 0.052 inches in thickness.

In an embodiment, the leading edge camber angle ranges from at or about 10 degrees to at or about 20 degrees. In an embodiment, the trailing edge camber angle ranges from at or about 10 degrees to at or about 20 degrees. In an embodiment, the stagger angle ranges from at or about 46 degrees to at or about 50 degrees.

In an embodiment, each of the plurality of blades has a maximum camber height located at a point ranging from at or about 40% to at or about 60% of the distance from the leading edge to the trailing edge along a chord length of that blade. In an embodiment, each of the plurality of blades has a maximum camber angle located at a point ranging from at or about 7% to at or about 13% of the distance from the leading edge to the trailing edge along a chord length of that blade.

In an embodiment, each of the plurality of blades has a blade depth ranging from at or about 0.2 to at or about 0.4 of the diameter of the centrifugal fan.

In an embodiment, the chord has a length L ranging from at or about 195 mm to at or about 215 mm.

In an embodiment, the blades each have a forward sweep ranging from at or about three to at or about six degrees. In an embodiment, the blades each have a radial sweep ranging from at or about three to at or about six degrees. In an embodiment, the centrifugal fan blade assembly includes at least five blades.

In an embodiment, the centrifugal fan blade assembly includes a motor hub attachment. In an embodiment, a centrifugal fan includes a motor and the blade assembly, joined at the motor hub attachment. In an embodiment, an HVACR system includes the centrifugal fan.

DRAWINGS

DETAILED DESCRIPTION

This disclosure is directed to high-efficiency centrifugal fans including blades having a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L divided by the diameter D of the centrifugal fan satisfies the inequality $0.25 \leq L/D \leq 0.42$.

Figure 1:
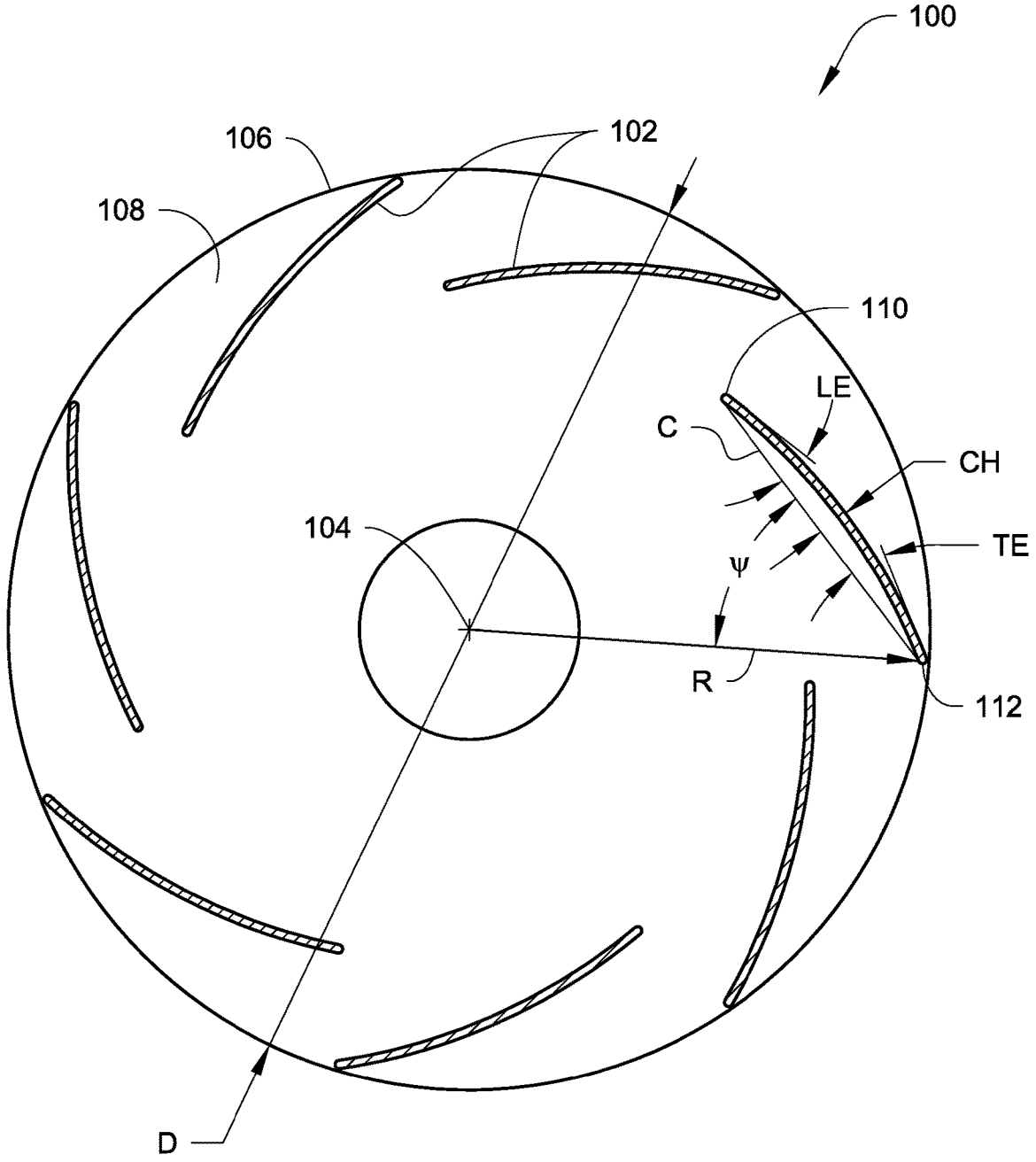
FIG. 1 shows a sectional view of a fan blade assembly according to an embodiment.

FIG. 1 shows a cross-section of a fan blade assembly according to an embodiment. Fan blade assembly 100 includes a plurality of blades 102, located between center point 104 and outer edge 106 of the fan wheel 108.

Fan wheel 108 is the fan wheel of a centrifugal blower. The centrifugal blower including fan wheel 108 may be part of a light commercial HVACR system, for example a three- to twenty-five-ton HVACR system. The centrifugal blower, when being rotated, takes air in axially and expels air radially with respect to the rotation of fan wheel 108. The size of fan wheel 108 may be based on the particular blower in which fan wheel 100 is to be used. Fan wheel 100, for example, may have a diameter ranging from at or about 275 mm or at or about 700 mm. In an embodiment, the fan wheel has a diameter ranging from at or about 275 to at or about 500 mm. In an embodiment, the fan wheel has a diameter ranging from at or about 500 mm to at or about 575 mm.

Fan wheel 108 may be joined to a motor 502 via a motor hub attachment 402, visible in the views of FIGS. 4 and 5 and described below. Fan wheel 108 may be driven to rotate about an axis by the motor 502. In an embodiment, the motor 502 is a variable-speed electric motor. Fan wheel 108 has a diameter D.

A plurality of blades 102 are included in fan blade assembly 100 and joined to fan wheel 108. Fan blade assembly 100 may have, for example, five to seven blades 102. In an embodiment, fan blade assembly 100 has six blades 102. In an embodiment, fan blade assembly 100 includes seven blades 102. The plurality of blades 102 may be distributed regularly around fan wheel 108, i.e. each blade evenly spaced from one another.

Each of blades 102 has a leading edge 110 and a trailing edge 112, the leading edge 110 and trailing edge 112 defined with respect to the direction of rotation of the fan. The shape and orientation of each of the blades 102 is described by the leading edge camber angle LE, trailing edge camber angle TE, stagger angle Ψ, and chord C of the blades 102.

Each of blades 102 has a chord C extending in a straight line from the leading edge 110 to the trailing edge 112. In an embodiment, the chord ranges from at or about 0.25 to 0.42 of the diameter of the fan wheel 108. In an embodiment including a fan wheel 100 with a diameter of at or about 500 mm, the chord ranges from at or about 195 to at or about 225 mm in length. In an embodiment, fan wheel 108 has a diameter D of at or about 500 mm and the chord C of each of the blades 102 is at or about 215 mm.

The leading edge camber angle LE of each of blades 102 at leading edge 110 is the angle between the chord and a line tangent to the blade 102 at the leading edge 110. In an embodiment, the leading edge camber angle LE of each of the blades 102 ranges from at or about 10 degrees to at or about 30 degrees. In an embodiment, the leading edge camber angle LE of each of the blades 102 ranges from at or about 10 degrees to at or about 20 degrees. In an embodiment, the leading edge camber angle ranges from at or about 10 degrees to at or about 15 degrees. In an embodiment, the leading edge camber angle LE is at or about 15 degrees.

The trailing edge camber angle TE of each of blades 102 at trailing edge 112 is the angle between the chord and a line tangent to the blade 102 at the trailing edge 112. In an embodiment, the trailing edge camber angle TE of each of the blades 102 ranges from at or about 10 degrees to at or about 30 degrees. In an embodiment, the trailing edge camber angle TE of each of the blades 102 ranges from at or about 10 degrees to at or about 15 degrees. In an embodiment, the trailing edge camber angle TE of each of the blades 102 is at or about 10 degrees. In an embodiment, the leading edge camber angle LE is greater than the trailing edge camber angle TE.

Each of blades 102 has a stagger angle Ψ, which is an angle between the chord and a line R extending from the center of the fan wheel 108 to the trailing edge 112 of the blade 102. In an embodiment, the stagger angle Ψ for each of the blades 102 ranges from at or about 35 degrees to at or about 55 degrees. In an embodiment, the stagger angle Ψ for each of the blades 102 is at or about 50 degrees.

In an embodiment, a camber height CH of each of the blades 102 is at a maximum at a point ranging from at or about 40% to at or about 60% of the distance from the leading edge 110 to the trailing edge 112 along the chord C. The camber height is a distance from the chord to the surface of the blade 102 itself.

In an embodiment, a camber angle along each of the blades 102 is at a maximum at a point ranging from at or about 7% to at or about 13% of the distance of chord length C when measured perpendicular to the chord line. The camber angle is the angle between a line tangent to that point along the blade 102 and the chord C.

In an embodiment, each of the blades 102 has a blade depth ranging from at or about 0.2 to at or about 0.4 of the diameter D of the centrifugal fan. The blade depth is the height that the blade 102 extends to from fan wheel 108.

In an embodiment, each of blades 102 has a consistent thickness along its entire length from the leading edge 110 to the trailing edge 112 of the blade 102, within manufacturing tolerances.

In an embodiment, each of blades 102 is made of sheet metal. In an embodiment, the sheet metal is sheet aluminum. In an embodiment, the sheet metal is sheet steel. In an embodiment, each of blades 102 is made of plastic. In an embodiment, the plastic is a nylon, for example nylon 6 or nylon 66. In an embodiment, each of the blades 102 is made of material including plastic and at or about 30 to 50% by mass of a glass fill. In an embodiment, fan wheel 102 is made of the same material as the blades 102. In an embodiment, fan wheel 100 and the plurality of blades 102 are formed integrally by injection molding.

In an embodiment where the blades are sheet metal, each of the blades may be at or about 0.052 inches in thickness. In an embodiment where the blades are plastic, each of the blades may be at or about 0.191 inches in thickness. These thicknesses may vary according to, for example, manufacturing tolerances, variance among providers of sheet metals or plastics, and the like.

Figure 2:
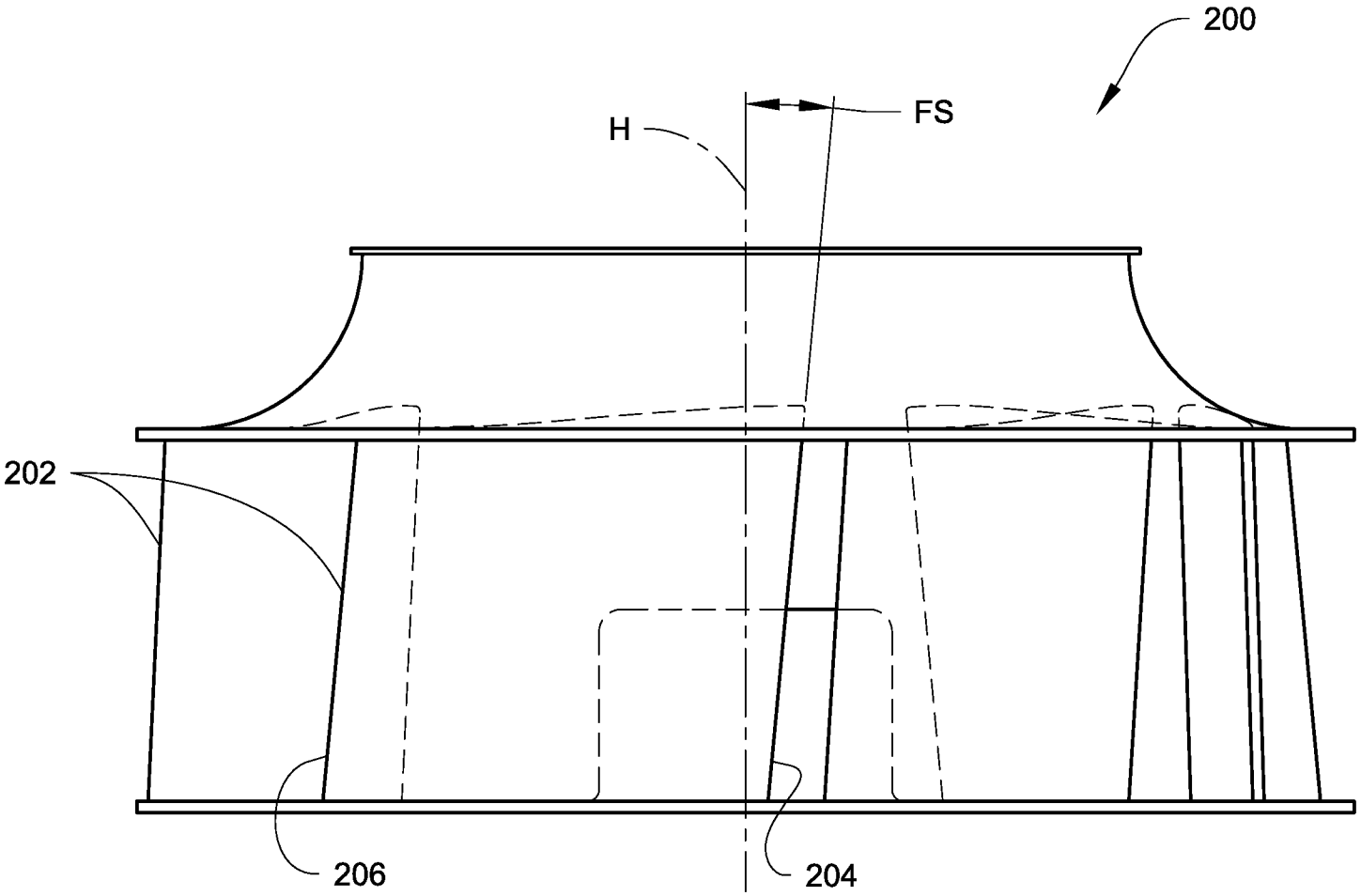
FIG. 2 shows a side view of a fan blade assembly according to an embodiment.

FIG. 2 shows a side view of a fan blade assembly 200 according to an embodiment. Blades 202 have a leading edge camber angle LE, trailing edge camber angle TE, stagger angle Ψ, and chord C as described above with respect to blades 102. In the embodiment shown in FIG. 2, the blades 202 each further have a forward sweep FS. The forward sweep FS is defined by the angle formed between a leading edge 204 or a trailing edge 206 of the blade 202 and a line parallel to the height direction H of the blade 202. In an embodiment, the blades 202 each have a forward sweep FS ranging from at or about three degrees to at or about six degrees.

Figure 3:
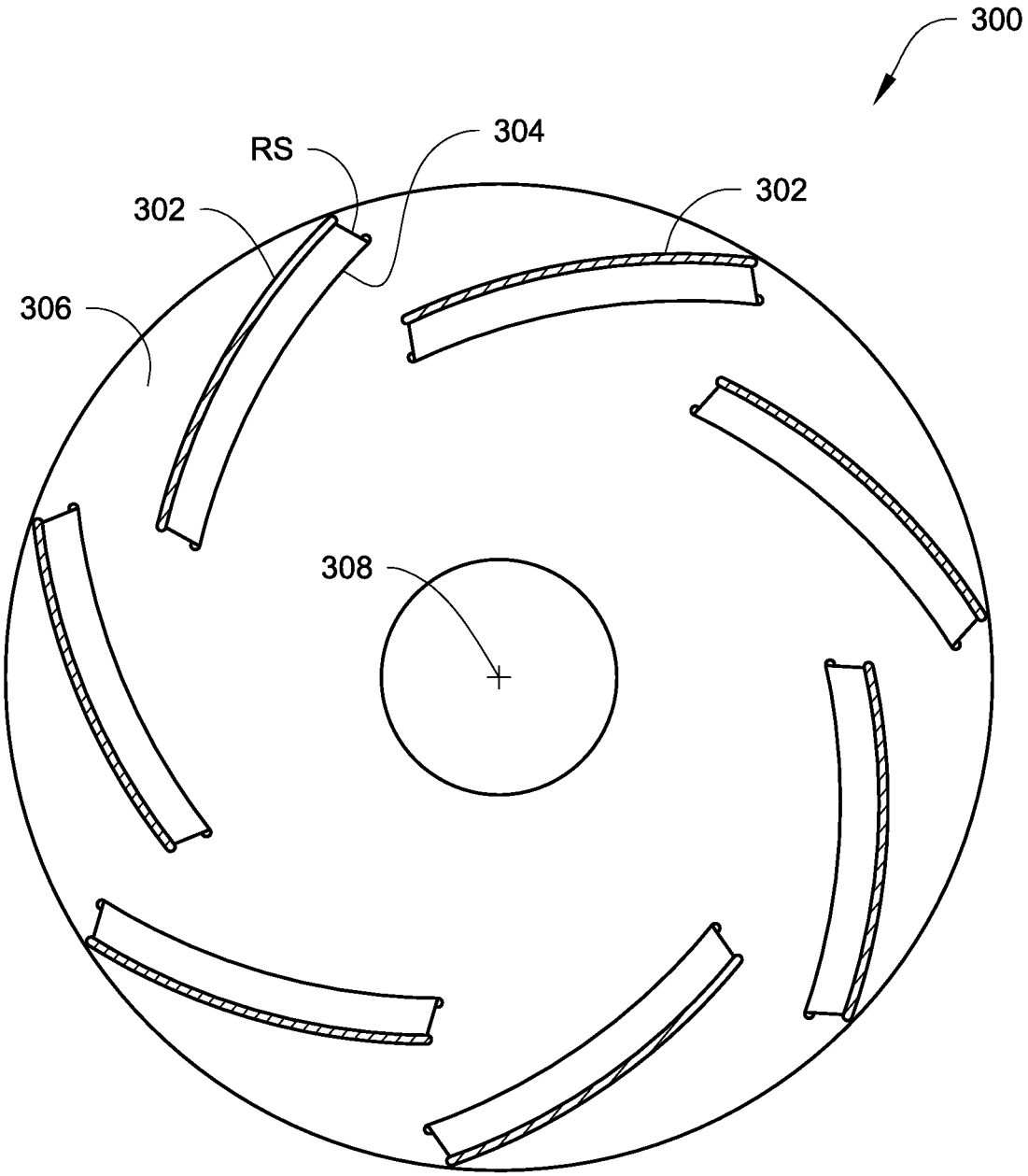
FIG. 3 shows a sectional view of a fan blade assembly according to an embodiment.

FIG. 3 shows a sectional view of fan blade assembly 300 according to an embodiment. Fan blade assembly includes a fan wheel 108 as described above. Fan blade assembly 300 includes a plurality of fan blades 302. Fan blades 302 each have a leading edge camber angle LE, trailing edge camber angle TE, stagger angle Ψ, and chord C as described above with respect to blades 102. Fan blades 302 each are joined to fan wheel 306 at their respective bases 304. The fan blades 302 extend away from base 304 and fan wheel 306, towards the plane along which the section of FIG. 3 is taken.

In the embodiment shown in FIG. 3, the blades 302 each further have a radial sweep as they extend away from the fan wheel 306. The radial sweep is a tilt of the blade 302 inward or outward with respect to a center 308 of the fan wheel 306 as the blades 302 extend away from fan wheel 306. The radial sweep is defined by the angle formed between the direction at which the blade 302 extends from fan wheel 306 and a line parallel to the axis of rotation (i.e. perpendicular to the plane of fan wheel 306, and also perpendicular to the plane along which the section is taken in FIG. 3) located at the base 304 of the blade 302. The line RS following the cross-section of the blade 302 and the line perpendicular to the fan wheel 306 at the base 304 form the angle defining the radial sweep of blade 302. In an embodiment, the radial sweep ranges from at or about three degrees to at or about six degrees.

In the embodiment shown in FIG. 3, blades 302 angle outwards from center 308 of fan wheel 306 by the radial sweep as the blades 302 extend from their respective bases 304 where the blades 302 are joined to the fan wheel 306, and towards the plane at which the section is taken in FIG. 3.

Figure 4:
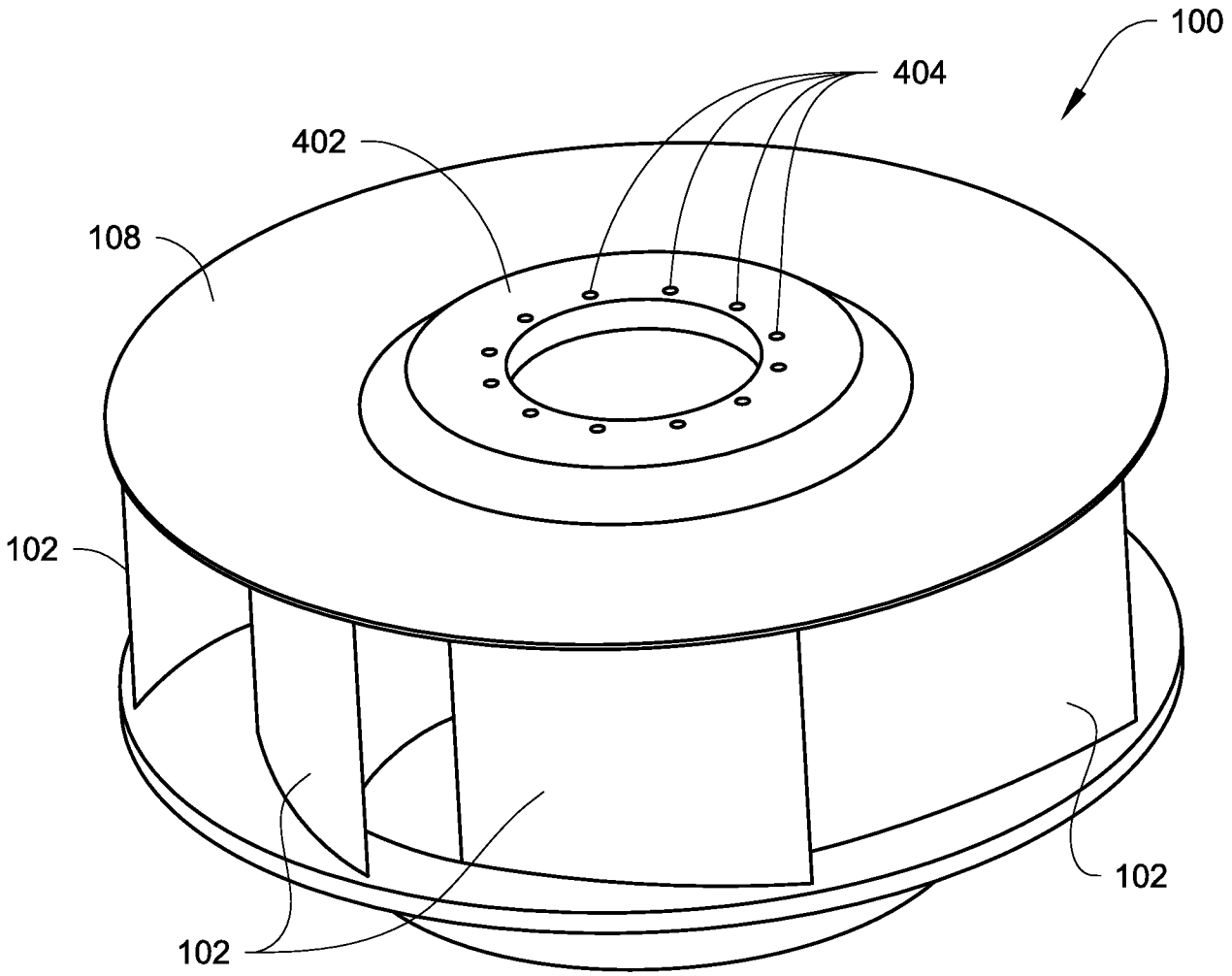
FIG. 4 shows a view of a fan blade assembly according to an embodiment.

FIG. 4 is another view of the fan blade assembly 100 of FIG. 1. In this view, motor hub attachment 402 is visible on a side of fan wheel 108 opposite the side from which blades 102 extend. Motor hub attachment 402 is configured to allow the mechanical connection of the fan blade assembly to a motor, such as a variable-speed electric motor. By connection to the motor, the fan blade assembly 100 may be driven to rotate by the motor, thus operating the fan including fan blade assembly 100. In an embodiment, motor hub attachment 402 includes a plurality of holes 404 configured to accept fasteners. In an embodiment, the holes are punched holes. In an embodiment, motor hub attachment 402 is a single opening configured to receive a shaft of a motor such as motor 502. In an embodiment, a motor shaft extending through the motor hub attachment 402 is joined to the fan blade assembly 100 via one or more engagement bolts extending through the motor shaft.

Figure 5:
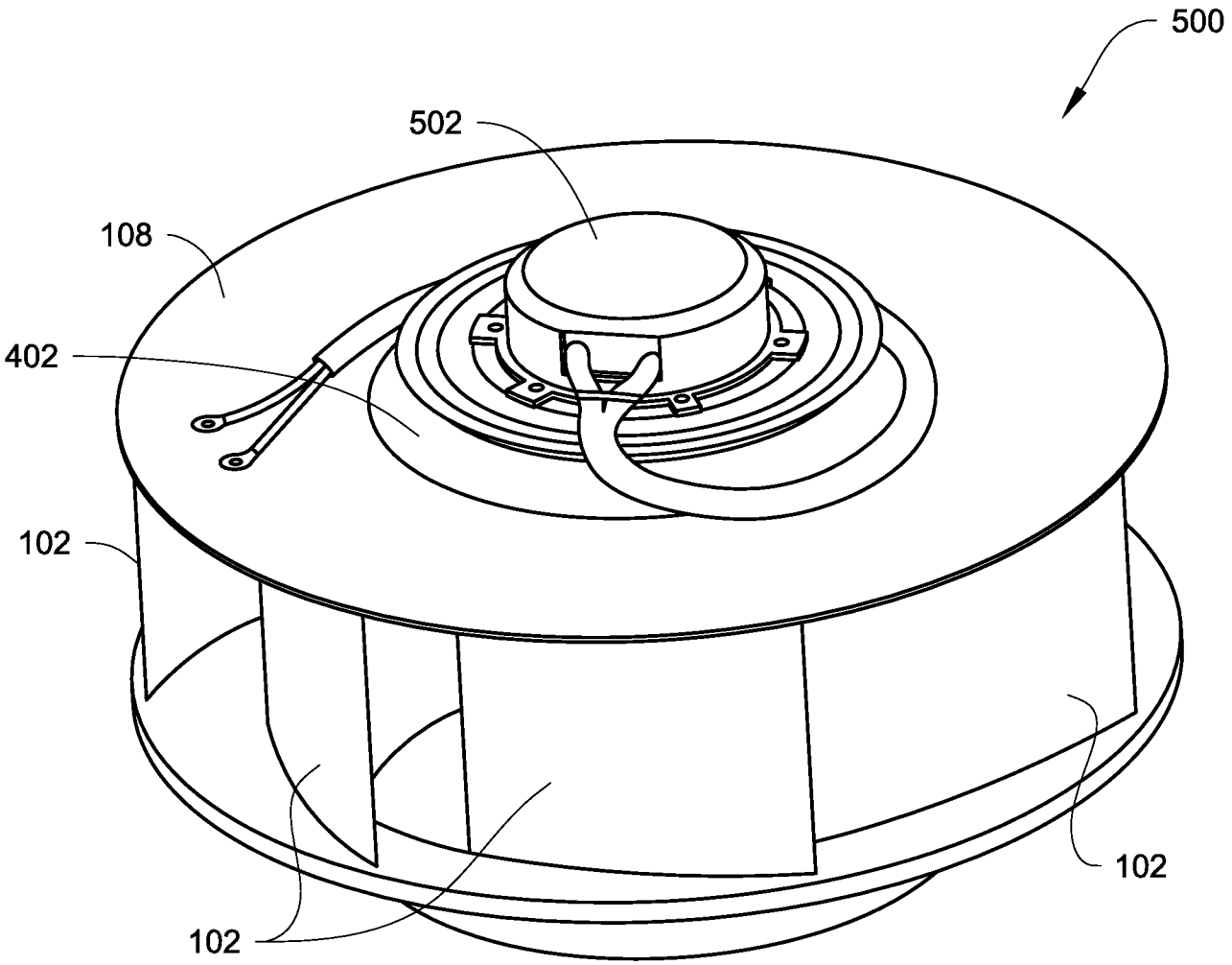
FIG. 5 shows an isometric view of a centrifugal fan according to an embodiment.

FIG. 5 shows a centrifugal fan 500 according to an embodiment. The fan blade assembly including fan wheel 108 and fan blades 102 is connected to motor 502 via motor hub attachment 402. Motor 502 connects to motor hub attachment 402 and drives the centrifugal fan to rotate. Motor 502 may be, for example, a variable speed electric motor. In an embodiment, motor 502 is an electrically communicated motor. In an embodiment, motor 502 includes a variable speed drive.

Figure 6:
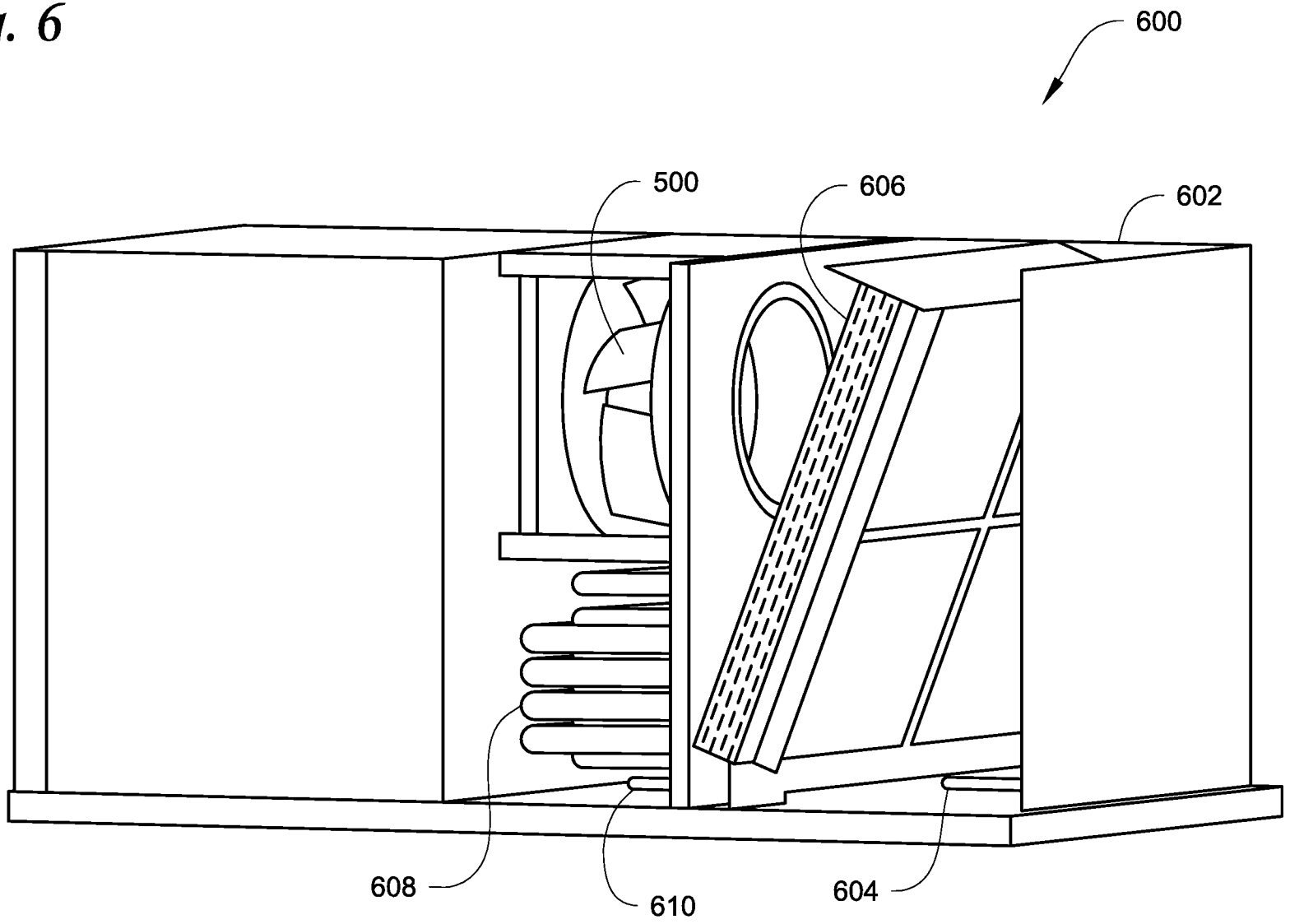
FIG. 6 shows an HVACR system including a centrifugal fan according to an embodiment.

FIG. 6 shows an HVACR system 600 including centrifugal fan 500. Air enters HVACR cabinet 602, through inlet 604 and is drawn through coil 606 by the centrifugal fan 500, which are mounted within HVACR cabinet 602. Air then passes over heater 608 and then out of the HVACR cabinet 602 via outlet 610.

HVACR cabinet 602 encloses and supports the components of HVACR system 600. Inlet 604 is an opening in HVACR cabinet 602 allowing air to flow into the HVACR cabinet 602 from either an enclosed space HVACR system 600 services, and/or air from the surroundings of HVACR system 600.

Coils 606 may, when HVACR system 600 is in an air conditioning mode, carry refrigerant and allow exchange of heat between air inside HVACR cabinet 602 and the refrigerant in coils 606 to cool air prior to the air being provided to the enclosed space.

The centrifugal fans 500 are mounted within HVACR cabinet 602 to drive air through the HVACR system 600. Operation of centrifugal fans 500 drives airflow through the HVACR system 600, and the power draw of the centrifugal fans 500 in operation is an element of the power consumption of HVACR system 600 during its operation. Operation of centrifugal fans 500 must provide sufficient air movement to satisfy the needs of the enclosed space for the flow of air from HVACR system 600.

Air exiting the centrifugal fans 500 may be directed through heater 608. When the HVACR system 600 is in a heating mode, the heater 608 releases heat to the air flowing over them, heating the air prior to the air being provided to the enclosed space. Heater 608 may be, for example, a gas heater or an electric heater. The air is provided to the enclosed space via an outlet 610, which is connected to, for example, ducts receiving the air from HVACR system 600.

Aspects:

It is understood that any of aspects 1-19 can be combined with aspect 20.

Aspect 1. A centrifugal fan blade assembly, comprising a fan wheel and a plurality of blades joined to the fan wheel, wherein each of the plurality of blades has a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L over the diameter of the centrifugal fan divided by the diameter D of the fan satisfies the inequality $0.25 \leq L/D \leq 0.42$.

Aspect 2. The centrifugal fan blade assembly according to aspect 1, wherein each of the plurality of blades has a consistent thickness from the leading edge of the blade to the trailing edge of the blade.

Aspect 3. The centrifugal fan blade assembly according to any of aspects 1-2, wherein the centrifugal fan blade assembly comprises a plastic.

Aspect 4. The centrifugal fan blade assembly according to aspect 3, wherein the centrifugal fan blade assembly further comprises glass fill in an amount of approximately 30% to 50% by mass.

Aspect 5. The centrifugal fan blade assembly according to any of aspects 3-4, wherein the plastic comprises nylon 6 or nylon 66.

Aspect 6. The centrifugal fan blade assembly according to any of aspects 1-2, wherein each of the plurality of blades comprises aluminum.

Aspect 7. The centrifugal fan blade assembly according to any of aspects 1-2, wherein each of the plurality of blades comprises steel.

Aspect 8. The centrifugal fan blade assembly according to any of aspects 1-7, wherein the leading edge camber angle is at or about 10 degrees to at or about 20 degrees.

Aspect 9. The centrifugal fan blade assembly according to any of aspects 1-8, wherein the trailing edge camber angle is at or about 10 degrees to at or about 20 degrees.

Aspect 10. The centrifugal fan blade assembly according to any of aspects 1-9, wherein the stagger angle is at or about 46 degrees to at or about 50 degrees.

Aspect 11. The centrifugal fan blade assembly according to any of aspects 1-10, wherein each of the plurality of blades has a maximum camber height at a point located from at or about 40% to at or about 60% of the distance from the leading edge to the trailing edge along a chord length of that blade.

Aspect 12. The centrifugal fan blade assembly according to any of aspects 1-11, wherein each of the plurality of blades has a maximum camber angle at a point located from at or about 7% to at or about 13% of the distance from the leading edge to the trailing edge along a chord length of that blade.

Aspect 13. The centrifugal fan blade assembly according to any of aspects 1-12, wherein each of the plurality of blades has a forward sweep of at or about three to at or about six degrees.

Aspect 14. The centrifugal fan blade assembly according to any of aspects 1-13, wherein each of the plurality of blades has a radial sweep of at or about three to at or about six degrees.

Aspect 15. The centrifugal fan blade assembly according to any of aspects 1-14, wherein the plurality of blades includes five or more blades.

Aspect 16. The centrifugal fan blade assembly according to any of aspects 1-15, wherein the chord has a length L of at or about 195 mm to at or about 215 mm.

Aspect 17. The centrifugal fan blade assembly according to any of aspects 1-16, further comprising a motor hub attachment.

Aspect 18. A centrifugal fan, comprising a motor and the centrifugal fan blade assembly according to aspect 17, wherein the centrifugal fan blade assembly is connected to the motor at the motor hub attachment.

Aspect 19. A heating, ventilation, air conditioning and refrigeration (HVACR) system, comprising the centrifugal fan according to aspect 18.

Aspect 20. A method of operating a heating, ventilation, air conditioning and refrigeration (HVACR) system, comprising using a motor to drive rotation of a blade assembly comprising a fan wheel and a plurality of blades joined to the fan wheel, wherein each of the plurality of blades has a leading edge camber angle of at or about 10 degrees to at or about 30 degrees, a trailing edge camber angle of at or about 10 degrees to at or about 30 degrees, a stagger angle of at or about 35 degrees to at or about 55 degrees, and a chord having a length L, wherein the length L over the diameter of the centrifugal fan divided by the diameter D of the fan satisfies the inequality $0.25 \leq L/D \leq 0.42$.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A centrifugal fan blade assembly, comprising a fan wheel and a plurality of blades joined to the fan wheel, wherein each of the plurality of blades has a leading edge camber angle of 10 degrees to 30 degrees, a trailing edge camber angle of 10 degrees to 30 degrees, a stagger angle of 35 degrees to 55 degrees, and a chord having a length L, wherein the length L over a diameter D of the centrifugal fan blade assembly satisfies the inequality $0.25 \leq L/D \leq 0.42$.

2. The centrifugal fan blade assembly of claim 1, wherein each of the plurality of blades has a consistent thickness from a leading edge of the blade to a trailing edge of the blade.

3. The centrifugal fan blade assembly of claim 1, wherein the centrifugal fan blade assembly comprises a plastic.

4. The centrifugal fan blade assembly of claim 3, wherein the centrifugal fan blade assembly further comprises glass fill in an amount of 30% to 50% by mass.

5. The centrifugal fan blade assembly of claim 3, wherein the plastic comprises nylon 6 or nylon 66.

6. The centrifugal fan blade assembly of claim 1, wherein each of the plurality of blades comprises aluminum.

7. The centrifugal fan blade assembly of claim 1, wherein each of the plurality of blades comprises steel.

8. The centrifugal fan blade assembly of claim 1, wherein the leading edge camber angle is 10 degrees to 20 degrees.

9. The centrifugal fan blade assembly of claim 1, wherein the trailing edge camber angle is 10 degrees to 20 degrees.

10. The centrifugal fan blade assembly of claim 1, wherein the stagger angle is 46 degrees to 50 degrees.

11. The centrifugal fan blade assembly of claim 1, wherein each of the plurality of blades has a maximum camber height at a point located from 40% to 60% of a distance from the leading edge to the trailing edge along a chord length of that blade.

12. The centrifugal fan blade assembly of claim 1, wherein each of the plurality of blades has a maximum camber angle at a point located from 7% to 13% of the distance from the leading edge to the trailing edge along a chord length of that blade.

13. The centrifugal fan blade assembly of claim 1, wherein each of the plurality of blades has a forward sweep of three to six degrees.

14. The centrifugal fan blade assembly of claim 1, wherein each of the plurality of blades has a radial sweep of three to six degrees.

15. The centrifugal fan blade assembly of claim 1, wherein the plurality of blades includes five or more blades.

16. The centrifugal fan blade assembly of claim 1, wherein the chord has the length L of 195 mm to 215 mm.

17. The centrifugal fan blade assembly of claim 1, further comprising a motor hub attachment.

18. A centrifugal fan, comprising a motor and the centrifugal fan blade assembly of claim 17, wherein the centrifugal fan blade assembly is connected to the motor at the motor hub attachment.

19. A heating, ventilation, air conditioning and refrigeration (HVACR) system, comprising the centrifugal fan of claim 18.

20. A method of operating a heating, ventilation, air conditioning and refrigeration (HVACR) system, comprising using a motor to drive rotation of a blade assembly comprising a fan wheel and a plurality of blades joined to the fan wheel, wherein each of the plurality of blades has a leading edge camber angle of 10 degrees to 30 degrees, a trailing edge camber angle of 10 degrees to 30 degrees, a stagger angle of 35 degrees to 55 degrees, and a chord having a length L, wherein the length L over a diameter D of the centrifugal fan blade assembly satisfies the inequality $0.25 \leq L/D \leq 0.42$.

* * * * *